United States Patent [19]

Mitsubayashi

[11] 4,055,099

[45] Oct. 25, 1977

[54] FOOD SLICER

[75] Inventor: Yoshihiko Mitsubayashi, Kuwana, Mie, Japan

[73] Assignee: Chubukoki Kabushiki Kaisha, Kuwana, Mie, Japan

[21] Appl. No.: 660,924

[22] Filed: Feb. 24, 1976

[30] Foreign Application Priority Data

| | | |
|---|---|---|
| Feb. 28, 1975 | Japan | 50-28200[U] |
| June 5, 1975 | Japan | 50-67773 |

[51] Int. Cl.[2] ..... B26D 7/06; B02C 17/02; B07B 13/00

[52] U.S. Cl. ..... 83/403; 241/95; 241/DIG. 17

[58] Field of Search ..... 241/DIG. 17, 242, 99, 241/222, 95; 99/589, 594, 595; 83/403, 411 R, 425

[56] References Cited

U.S. PATENT DOCUMENTS

| | | | |
|---|---|---|---|
| 1,847,000 | 2/1932 | Englen | 83/403 |
| 2,386,021 | 10/1945 | Wetmore | 241/95 |
| 2,940,678 | 6/1960 | Sharpe et al. | 241/DIG. 17 |
| 2,961,024 | 11/1960 | Urschel et al. | 83/403 |
| 3,857,310 | 12/1974 | Tiby | 83/403 |

*Primary Examiner*—Othell M. Simpson
*Attorney, Agent, or Firm*—Pierce, Scheffler & Parker

[57] ABSTRACT

A foodstuff slicer which is particularly useful for shaving ice, frozen fruits and the like is disclosed. The foodstuff slicer is provided with a rotor composed of a downwardly diverging hood, a plurality of carrier-arms and a boss connected to a vertical driving shaft. The carrier-arms extend radially and upwardly in spaced relation with a wall of a conical case which diverges upwardly. A cutting blade is attached to a upper portion of the conical case. Centrifugal forces acting on lumps of foodstuff become nearly maximum at the position of the cutting blade to slice the foodstuff steadily.

2 Claims, 8 Drawing Figures

FOOD SLICER

This invention relates to a device for slicing lumps of foodstuffs such as ice, frozen fruits, dried fish and the like.

Ice-shavers (ice-slicers) of heretofore known type are constructed to offer a rotary or reciprocal motion at a relatively large block of ice with respect of a stationary cutting blade. However, this type of ice-shaver cannot shave all of the block, and further, cannot yield especially fine powder-like ice.

A principal object of the present invention is to provide a food-slicer for slicing ice or the like which is improved in the above-mentioned respects.

Another object of the present invention is to provide a food-slicer of compact construction which is especially convenient for use in a shop.

Other objects and advantages of the present invention will be apparent from a consideration of the following description, taken in connection with the accompanying drawings, in which.

Figure 1:
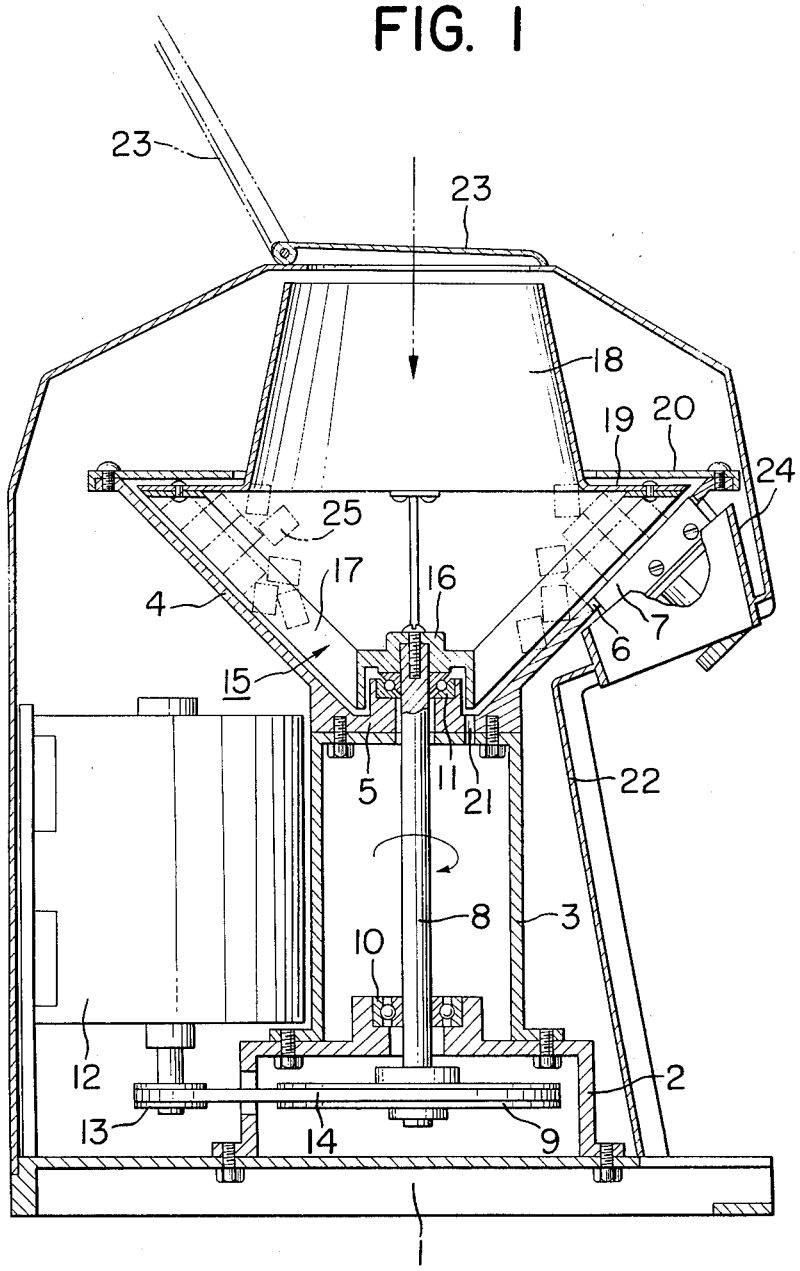
FIG. 1 is a vertically sectioned view of a food-slicer according to the present invention.
Figure 2:
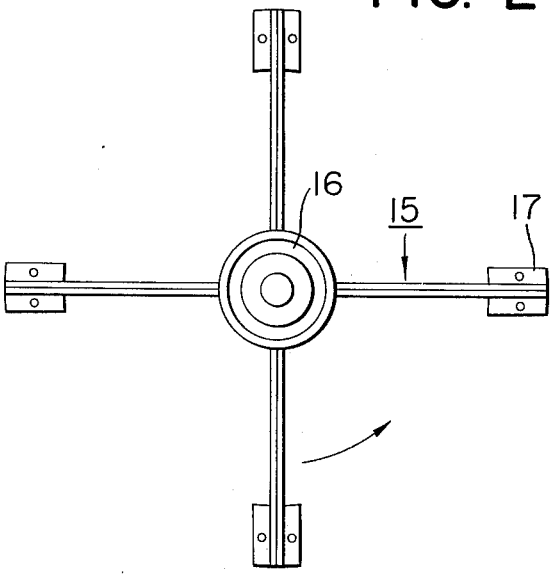
FIG. 2 is a plan view of carrier-arms and a boss supporting the carrier-arms.

Referring now to FIG. 1, the food-slicer is provided with a bed or base 1 on which a pulley-housing 2, a shaft-housing 3 and a conical case 4 are mounted successively. The conical case 4 diverges upwardly to receive lumps of ice or the like, and is provided with a portion 5 for receiving a bearing 11 at its bottom and a slot 6 for discharging sliced foodstuff at the upper portion of its conical wall. A cutting blade 7 surrounded by the slot 6 is provided further to the conical case 4 to slice lumps or foodstuff fed into it. A bearing 10 on pulley-housing 2 and a bearing 11 provided at the above-mentioned portion 5 support a vertical shaft 8, and this shaft is connected at its upper end to a rotor 15 which is driven by an electric motor 12 through a pulley 13, a belt 14 and pulley 9 in pulley-housing 2.

Rotor 15 is composed of a boss 16 as a lower member, a plurality of carrier-arms 17 as middle members and a downwardly diverging hopper 18 as an upper member. Hopper 18 is provided with an outwardly extending wide flange 19 at its lower end. Boss 16 of rotor 15 is connected to the upper end of vertical shaft 8. Each of the carrier-arms 17 extends radially and upwardly in spaced relation with the wall of the conical case 4, and its upper end is connected to flange 19 of hopper 18.

A flat annular plate 20 is attached to conical case 4 so as to cover the portion near the hopper 18 of flange 19. 21 designates a drain-hole provided at the bottom of conical case 4. To cover various parts, a hood 22, having a lid 23 and a chute 24, is attached to the bed 1.

When lumps of ice are fed through hopper 18 and the electric motor 12 is started, the lumps of ice are rotated about the axis of the vertical shaft 8 by the carrier-arms 17. As both the hopper 18 and the carrier-arms 17 are a part or parts of the rotor 15, the lumps of ice in the hopper 18 and lumps of ice in the conical case 4 are rotated at nearly equal speed and are shaved by the cutting blade 7.

The following points are important about the action of the device.

a. Centrifugal forces acting on the lumps of ice are maximum when they come to a place at which the cutting blade 7 is provided.

b. The hopper 18 diverges downwardly so as by its wall to guide the lumps of ice towards conical case 4.

c. The lumps of ice are moved up the wall of conical case 4 by centrifugal forces which will increase gradually.

d. The shaving of ice by cutting blade 7 is carried out steadly.

The food-slicer can be operated without generating disagreeable noise, and, further, can be fed lumps of ice during operation, due to the above points *a* to *d*.

A small amount of water yielded in conical case 4 by melting of ice flows down along the wall of the conical case to reach drain-hole 21. And, ice shaved by the cutting blade 7 passes through slot 6 without containing water. Thus, the shaved ice is fine and snow-like.

Figure 3:
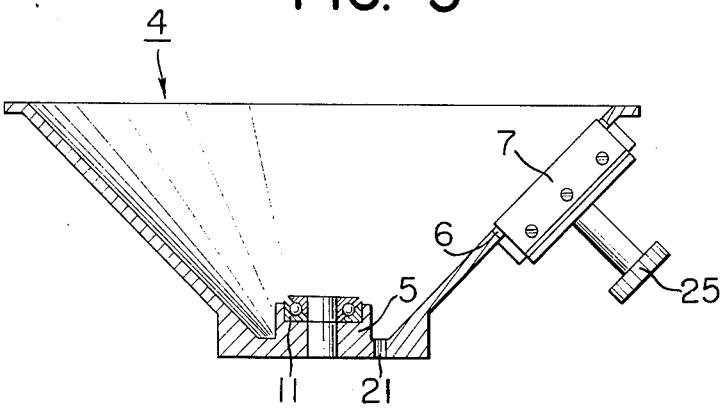
FIG. 3 and FIG. 4 are vertically sectioned views of conical cases.
Figure 4:
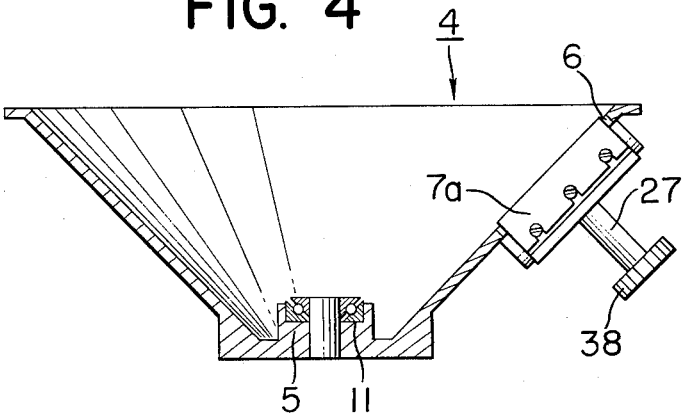
Figure 5:
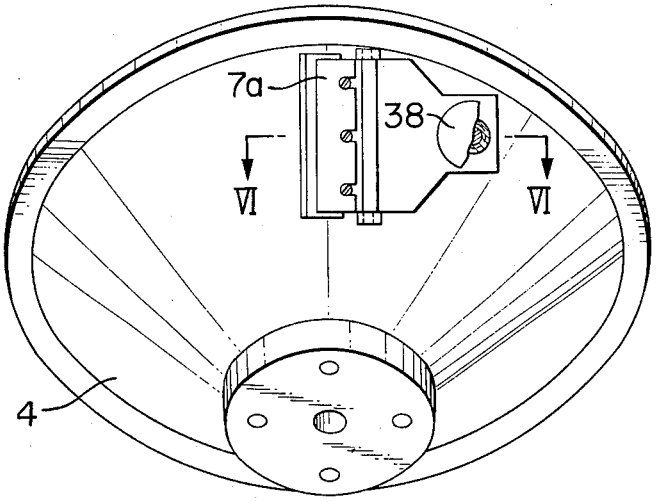
FIG. 5 is a perspective view of the conical case shown in FIG. 4.

The construction near blade 7 is schematically shown in FIG. 1 and FIG. 3, and the detailed construction is shown in FIGS. 5 to 8 inclusive. In these figures the cutting blade is designated by a notation "7*a*".

Figure 6:
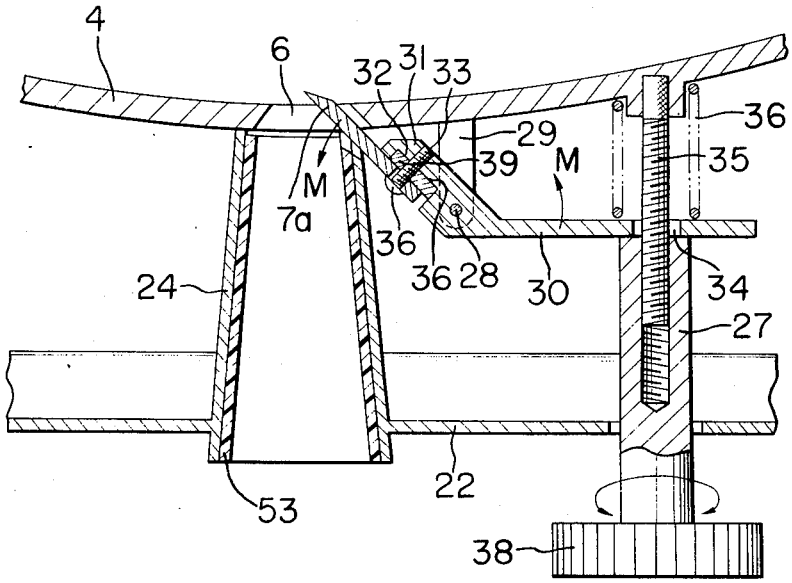
FIG. 6 is a sectional view taken in VI—VI line of FIG. 5.

Referring to FIG. 6, there is provided a lever 30 which is mounted on a bracket 29 by means of a pin 28. The lever 30 carries a cutting blade 7*a* by its portion 31, and it is rotated by an adjuster 27 with a handle 38 about the pin 28 to adjust the extent of projection of cutting blade 7*a* in conical case 4. The adjuster 27 abuts to the tail-end of the lever 30 by a spring 36, and further, it engages with a stud 35 which extends from the conical case 4 to pass through a hole 34 provided on the tail-end of the lever 30. When the lever 30 is turned in a direction shown by "M", the extent of projection of cutting blade 7*a* is decreased, and vice versa.

Figure 7:
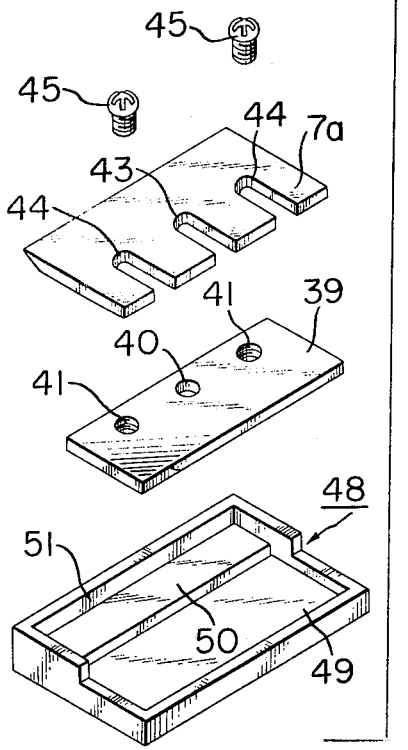
FIG. 7 is a perspective view showing a cutting blade, a back-plate and a jig.
Figure 8:
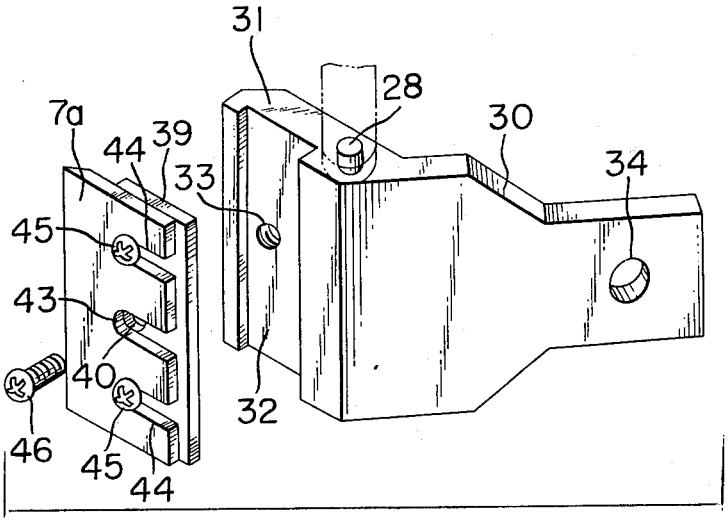
FIG. 8 is a perspective view for explaining setting of the cutting-blade.

Referring to FIGS. 7 and 8, the cutting blade 7*a* is provided with a pair of slots 44 for fixing it to a back-plate 30 by screws 45, and with a slot 43 for fixing the back plate 39 and the cutting blade 7*a* to portion 31 of lever 30 by a screw 46. Portion 31 is provided with a recess for receiving the back plate 39. The back plate 39 is provided with a pair of tapped holes 47 to receive screws 45, and with a hole 40 through which the shank of screw 46 passes. Screw 46 is fitted to a tapped hole 33 provided for portion 31 of lever 30.

The assembling of the above parts is carried out accurately by using a jig 48 shown in FIG. 7. Jig 48 is provided with a recess 29 for receiving back-plate 39 snugly, a surface 50 for resting the cutting blade 7*a* and a surface 51 for determining the direction of the edge of the cutting blade 7*a*.

Referring again to FIG. 6, the chute 24 may be, and preferably is, lined with a layer 53 of heat-insulating material which does not absorb water. The provision of this layer 53 is also important to avoid melting of shaved ice.

I claim:

1. A slicer for foodstuffs, comprising a. an upwardly diverging conical case with a slot in an upper part thereof for discharging sliced foodstuff and with a recess for receiving a bearing at its bottom;

b. a flat ring attached to the top end of the conical case to cover its upper portion;

c. a cutting blade attached to the conical case at a portion of the case above said slot to slice lumps of foodstuff;

d. a rotor assembly consisting of a downwardly diverging hopper as an upper member, a plurality of carrier-arms as intermediate members and a boss as a bottom-member, the hopper being provided with an outwardly extending wide flange at its bottom, and the carrier-arms being connected at their top-ends and at the bottom ends to the said flange and said boss, respectively; and e. a vertical shaft connected to the rotor and its driving means including an electric motor.

2. A foodstuff slicer according to claim 1, wherein the cutting blade is carried by a pivotally mounted lever, and wherein an adjusting means to rotate said lever about the axis of its pivotal mounting is provided.

* * * * *